US011153949B2

(12) United States Patent
Yang

(10) Patent No.: US 11,153,949 B2
(45) Date of Patent: Oct. 19, 2021

(54) SMART DUMMY-LOAD ELECTRICITY CONSUMPTION SYSTEM

(71) Applicant: iDESYN Semiconductor Corp., Zhubei (TW)

(72) Inventor: Shih-Hsueh Yang, Zhubei (TW)

(73) Assignee: IDESYN SEMICONDUCTOR CORP., Zhubei (TW)

( * ) Notice: Subject to any disclaimer, the term of this patent is extended or adjusted under 35 U.S.C. 154(b) by 0 days.

(21) Appl. No.: 16/788,901

(22) Filed: Feb. 12, 2020

(65) Prior Publication Data

US 2020/0260552 A1 Aug. 13, 2020

(30) Foreign Application Priority Data

Feb. 13, 2019 (TW) ..... 108104825

(51) Int. Cl.
*H05B 45/39* (2020.01)
*H05B 45/345* (2020.01)
*H05B 45/34* (2020.01)

(52) U.S. Cl.
CPC ..... *H05B 45/39* (2020.01); *H05B 45/34* (2020.01); *H05B 45/345* (2020.01)

(58) Field of Classification Search
CPC .... H05B 45/14; H05B 45/325; H05B 45/345; H05B 45/36; H05B 45/48; H05B 45/10; H05B 45/30; H05B 45/34; H05B 45/37; H05B 45/39; H05B 45/395; H05B 45/50; H05B 45/56; H05B 47/135
See application file for complete search history.

(56) References Cited

U.S. PATENT DOCUMENTS

2019/0003810 A1* 1/2019 Rastegar ..... F41B 9/0021

* cited by examiner

*Primary Examiner* — Monica C King
(74) *Attorney, Agent, or Firm* — Muncy, Geissler, Olds & Lowe, P.C.

(57) ABSTRACT

The present invention provides a smart dummy-load electricity consumption system, comprising: a switching detection module and a discharge module. The switching detection module comprises a power source input module and a filter circuit provided at an output of the power source input module, wherein the filter circuit supplies electricity to a working unit, the output of the power source input module is connected with a first controller, and the filter circuit has an output connected with a second controller. The discharge module comprises a switch unit connected to the working unit and a logic gate for turning on or off the switch unit, wherein the logic gate has an input end connected to an output end of the first controller, has an input end connected to an output end of the second controller, and is configured to output a control signal for turning on or off the switch unit.

12 Claims, 2 Drawing Sheets

SMART DUMMY-LOAD ELECTRICITY CONSUMPTION SYSTEM

BACKGROUND OF THE INVENTION

1. Technical Field

The present invention relates to a control circuit and more particularly to a smart dummy-load electricity consumption system for discharging a filter capacitor rapidly.

2. Description of Related Art

A light-emitting diode (LED) is a semiconductor-based electronic device capable of emitting light and is a composite light source made up of a trivalent element and a pentavalent element. Emerging as early as 1962, such electronic devices could only emit low-brightness red light at first and were used by Hewlett-Packard, which bought the LED patent, as indicator light. Other monochromatic LEDs were gradually developed later on. Today, LEDs can emit a wide spectrum of light, ranging from visible light to infrared and ultraviolet, and the luminance of LEDs has improved considerably. With the advent of white LEDs, recent years have seen LEDs in extensive use in lighting applications.

To drive an LED into operation, an LED driving circuit is required. LED driving circuits have higher operability than those for driving the conventional light sources because LEDs can be turned off immediately. As commercially available LEDs are mostly designed to be driven by a direct-current (DC) power source, most of the power sources intended for driving LEDs are switch-controlled DC voltage sources. Nowadays, power sources for driving LEDs are typically single-pole disconnector-based power factor correction converters, whose driving circuits advantageously feature high efficiency, high power factors, small harmonic waves, and low cost.

Such an LED driving circuit, however, has significant low-frequency ripples in its output, so it is common practice to add a high-capacity filter capacitor at the output end of the LED driving circuit in order to minimize the ripples. Nevertheless, the filter capacitor leads to a slow voltage drop at the output end of the LED driving circuit when power is cut off from the LED driving circuit, the culprit being the large amount of energy stored in the filter capacitor. As a result, the LED lamp in question remains lit for some time (i.e., produces an afterglow) after it is switched off; that is to say, turning off the power source will not stop the operation of the LED lamp immediately.

BRIEF SUMMARY OF THE INVENTION

The primary objective of the present invention is to provide a smart dummy-load electricity consumption system, comprising: a switching detection module and a discharge module. The switching detection module comprises a power source input module and a filter circuit provided at an output of the power source input module, wherein the filter circuit supplies electricity to a working unit, the output of the power source input module is connected with a first controller, and the filter circuit has an output connected with a second controller. The discharge module comprises a switch unit connected to the working unit and a logic gate for turning on or off the switch unit, wherein the logic gate has an input end connected to an output end of the first controller, has an input end connected to an output end of the second controller, and is configured to output a control signal for turning on or off the switch unit.

Furthermore, a counter is connected between the first controller and the logic gate, and a reset input of the counter is connected to the first controller, to trigger or reset a count according to an output and a clock input of the first controller in order to switch a voltage output between high and low.

Furthermore, the counter counts in binary numbers and changes its output voltage level when the count arrives at a preset value.

Furthermore, a Schmitt trigger is connected between the first controller and the counter.

Furthermore, the second controller includes a Schmitt trigger.

Furthermore, an inverter is connected between the counter and the logic gate.

Furthermore, the logic gate is an AND gate.

Furthermore, the filter circuit is a series-connected inductor-capacitor circuit.

Furthermore, the switching detection module includes a rectifier circuit provided between the filter circuit and the power source input module.

Furthermore, the working unit is a light-emitting diode (LED) module.

Comparing to the conventional techniques, the present invention has the following advantages:

1. The present invention can rapidly switch the circuit of an electrical load to the ground and thereby provide an effective solution to the afterglow phenomenon.

2. Unlike the conventional dummy-load resistors, the present invention discloses a constant-current dummy load design that outputs the energy of (i.e., discharges) a capacitor linearly to shorten the discharge time.

DETAILED DESCRIPTION OF THE INVENTION

The details and technical solution of the present invention are hereunder described with reference to accompanying drawings. For illustrative sake, the accompanying drawings are not drawn to scale. The accompanying drawings and the scale thereof are not restrictive of the present invention.

The present invention provides a smart dummy-load electricity consumption system that can be applied to any circuits to enable rapid discharge. In a preferred embodiment of the invention, the smart dummy-load electricity consumption system is applied to an LED driving circuit to rapidly release the energy of the capacitor in the driving circuit when the driving circuit is powered off, thereby allowing the LED(s) driven by the driving circuit to be turned off immediately without producing an afterglow.

Figure 1:
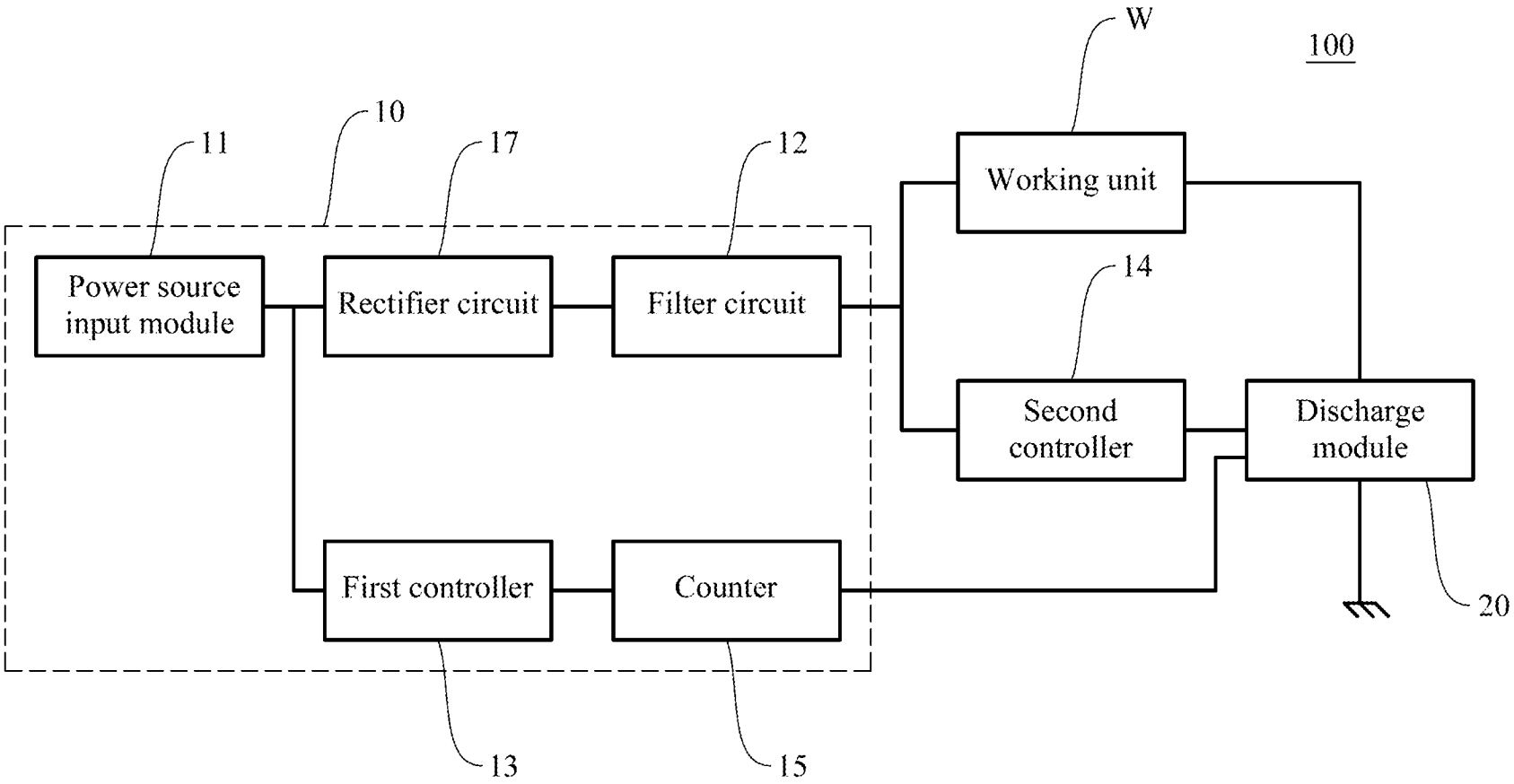
FIG. 1 is a block diagram of a smart dummy-load electricity consumption system according to the present invention.
Figure 2:
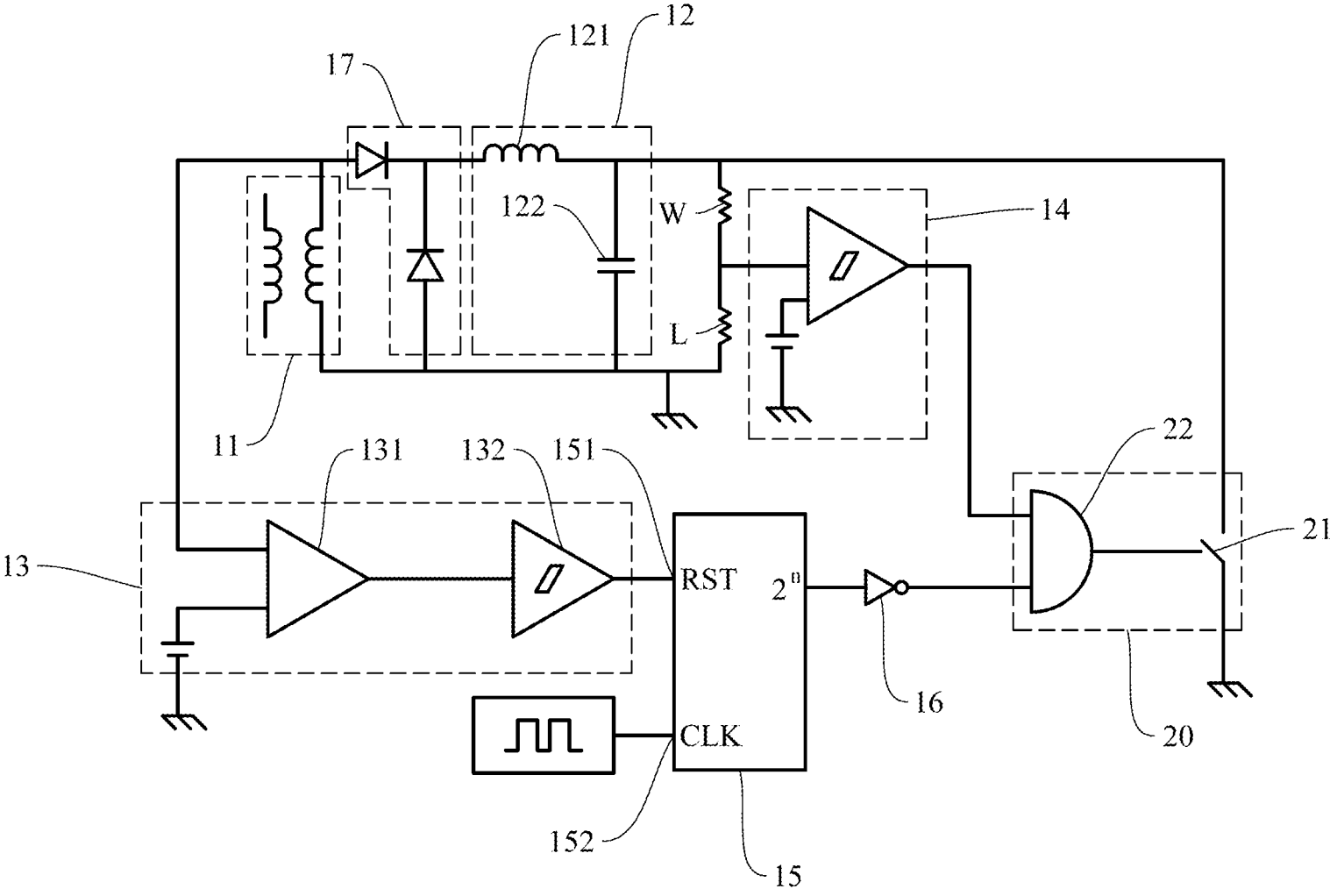
FIG. 2 is a circuit diagram of a smart dummy-load electricity consumption system according to the present invention.

A detailed description of an embodiment of the present invention is given below with reference to FIG. 1 and FIG. 2, which are respectively a block diagram and a circuit diagram of a smart dummy-load electricity consumption system according to the invention.

This embodiment discloses a smart dummy-load electricity consumption system 100 that includes a switching detection module 10 and a discharge module 20 connected to the switching detection module 10.

The switching detection module 10 includes a power source input module 11 and a filter circuit 12 provided at the output of the power source input module 11. The power source input module 11 may be a primary-secondary winding pair or other similar power supply modules; the present invention has no limitation in this regard. The output end of the power source input module 11 is connected with a first controller 13, while the output of the filter circuit 12 is connected with a second controller 14. In a preferred embodiment, the filter circuit 12 includes an inductor 121 and a capacitor 122 that are connected in series to provide voltage and current stabilization, and the rear end of the series-connected inductor-capacitor circuit is connected with a working unit W and a load resistor L, wherein the working unit W is connected in parallel to the capacitor 122. In a preferred embodiment, the working unit W is an LED module; the invention, however, has no limitation on the configuration of the working unit W. The load resistor L is connected in series to the working unit W to control the input current of the working unit W. The switching detection module 10 further includes a rectifier circuit 17 provided between the series-connected inductor-capacitor circuit (i.e., the filter circuit 12) and the power source input module 11. The rectifier circuit 17 is configured to perform DC-AC (alternating current) conversion so that the working unit W can be supplied with DC power.

The discharge module 20 includes a switch unit 21 connected in parallel to the working unit W and a logic gate 22 for turning on or off the switch unit 21. The input ends of the logic gate 22 are connected respectively to the output end of the first controller 13 and the output end of the second controller 14 in order for the logic gate 22 to output through its output end a control signal for turning on or off the switch unit 21. In this embodiment, the logic gate 22 is an AND gate. The type of the logic gate 22, however, may vary according to practical needs. For example, the logic gate 22 may be an OR gate, a NAND gate, or a NOR gate instead in response to a change in circuit design (e.g., when more logic gates and/or more inverters are used or when the trigger condition of the counter is changed); the present invention has no limitation in this regard.

In addition, a counter 15 is connected between the first controller 13 and the logic gate 22. The counter 15 includes a reset input 151 and a clock input 152. When the signal at the reset input 151 is low, the counter 15 is triggered to count by the clock signal at the clock input 152, and once the count reaches a preset value, the counter 15 outputs a low voltage. The counter 15 is reset when the signal at the reset input 151 is high. In a preferred embodiment, the counter 15 counts in binary numbers and changes its output from high to low when the count arrives at the preset value. An inverter 16 is connected between the counter 15 and the logic gate 22 and works with the logic gate 22 to provide the desired logic control. The arrangement for logic control may vary with the type of the logic gate 22 to meet design requirements. The counter 15 is intended to eliminate the noise resulting from non-linear temporal variation of the input square waves.

In a preferred embodiment, the first controller 13 includes an operational amplifier (OPA) 131 and a Schmitt trigger 132. The OPA 131 serves to filter out the negative half waves of the AC square-wave voltage input by the power source input module 11. The Schmitt trigger 132 is provided at the rear end of the OPA 131. The second controller 14 includes another Schmitt trigger for reducing high-frequency noise, enhancing signal stability, and thereby ensuring that the numerical signal output by the second controller 14 is switched between high and low.

The circuit structure of the present invention has been detailed above. The following paragraphs will describe the logic-controlled operation of the circuit at greater length.

When the power source input module 11 begins to supply electricity (i.e., when the switch of the power source is turned on), the first controller 13 compares the voltage of the power source input module 11 with a preset voltage level. As the voltage of the power source input module 11 is higher than the preset voltage level when the power source input module 11 is activated, the first controller 13 outputs a high voltage as a result of the comparison. The output high voltage undergoes oscillation in the Schmitt trigger 132 and is output to the counter 15 as high.

The counter 15 is continuously reset by the high output signal received, so the output of the counter 15 stays high (i.e., the value 1) and is output by the inverter 16 as the value 0. In the meantime, the current input into the filter circuit 12 charges the inductor 121 and the capacitor 122 such that the second controller 14 receives a high voltage and outputs the value 1. The AND gate 22 outputs the value 0 after receiving the value 0 from the inverter 16 and the value 1 from the second controller 14, and the switch unit 21 is turned off (i.e., forms an opened circuit) as a result, allowing the input voltage to be supplied to the working unit W (e.g., an LED module).

When the power switch is turned off, the first controller 13 compares the voltage of the power source input module 11 with the preset voltage level at once. As the voltage of the power source input module 11 is lower than the preset voltage level when the power is turned off, the first controller 13 outputs a low voltage, which undergoes oscillation in the Schmitt trigger 132 and is output to the counter 15 as low.

Now that the signal at the reset pin of the counter 15 has changed from high to low, the counter 15 starts to count according to the clock. Once the count reaches a preset value, the output of the counter 15 is changed from high (i.e., the value 1) to low (i.e., the value 0) and is output by the inverter 16 as the value 1. Meanwhile, the output of the second controller 14 is still a high voltage (i.e., the value 1) due to the fact that the capacitor 122 has yet to release the energy stored therein. So, with both inputs being the value 1, the AND gate 22 outputs the value 1 to turn on the switch unit 21, allowing the energy of the capacitor 122 to be released (i.e., guided to the ground) and hence reduced (which also results in a low output signal of the second controller 14), thereby turning off the working unit W (e.g., the LED module) immediately.

In summary of the above, the present invention can rapidly switch the circuit of an electrical load to the ground and thereby provide an effective solution to the afterglow phenomenon. Unlike the conventional dummy-load resistors, the present invention discloses a constant-current dummy load design that outputs the energy of (i.e., discharges) a capacitor linearly to shorten the discharge time.

The above is the detailed description of the present invention. However, the above is merely the preferred embodiment of the present invention and cannot be the limitation to the implement scope of the invention, which means the variation and modification according to the present invention may still fall into the scope of the invention.

What is claimed is:

1. A smart dummy-load electricity consumption system, comprising:

a switching detection module comprising a power source input module for providing sustained power, and a filter circuit provided at an output of the power source input module, wherein the filter circuit supplies electricity to a light-emitting diode (LED) module, the output of the power source input module is connected with a first controller, and the filter circuit has an output connected with a second controller; and a discharge module comprising a switch unit that is in parallel to the LED module and a logic gate for turning on or off the switch unit, wherein the logic gate has an input end connected to an output end of the first controller, has an input end connected to an output end of the second controller, and is configured to output a control signal for turning on or off the switch unit, as a power switch is turned off, the switch unit being turned on, allowing a capacitor's energy to be guided to the ground and hence results in a low output signal of the capacitor and the second controller for high speed cutting-off the LED module immediately to solve the afterglow problem of the LED module.

2. The smart dummy-load electricity consumption system of claim 1, wherein a counter is connected between the first controller and the logic gate, and a reset input of the counter is connected to the first controller to trigger or reset a count according to an output and a clock input of the first controller in order to switch a voltage output between high and low.

3. The smart dummy-load electricity consumption system of claim 2, wherein the counter counts in binary numbers and changes its output voltage level when the count arrives at a preset value.

4. The smart dummy-load electricity consumption system of claim 2, wherein a Schmitt trigger is connected between the first controller and the counter.

5. The smart dummy-load electricity consumption system of claim 1, wherein the second controller includes a Schmitt trigger.

6. The smart dummy-load electricity consumption system of claim 2, wherein the second controller includes a Schmitt trigger.

7. The smart dummy-load electricity consumption system of claim 3, wherein the second controller includes a Schmitt trigger.

8. The smart dummy-load electricity consumption system of claim 4, wherein the second controller includes a Schmitt trigger.

9. The smart dummy-load electricity consumption system of claim 5, wherein an inverter is connected between the counter and the logic gate.

10. The smart dummy-load electricity consumption system of claim 9, wherein the logic gate is an AND gate.

11. The smart dummy-load electricity consumption system of claim 10, wherein the filter circuit is a series-connected inductor-capacitor circuit.

12. The smart dummy-load electricity consumption system of claim 10, wherein the switching detection module includes a rectifier circuit provided between the filter circuit and the power source input module.

* * * * *